US007444917B1

(12) United States Patent
Elliott

(10) Patent No.: US 7,444,917 B1
(45) Date of Patent: Nov. 4, 2008

(54) BRAIDING STAND

(76) Inventor: Lois Elliott, 1798 E. Jamison Ave., Centennial, CO (US) 80122

( * ) Notice: Subject to any disclaimer, the term of this patent is extended or adjusted under 35 U.S.C. 154(b) by 0 days.

(21) Appl. No.: 11/844,866

(22) Filed: Aug. 24, 2007

(51) Int. Cl.
*D04C 7/00* (2006.01)

(52) U.S. Cl. ..... 87/62

(58) Field of Classification Search ..... 87/25, 87/62; 19/65 R; 81/484, 488; D8/71, 499
See application file for complete search history.

(56) References Cited

U.S. PATENT DOCUMENTS

| | | | | | |
|---|---|---|---|---|---|
| 2,939,360 | A | * | 6/1960 | Carten | 87/62 |
| 3,955,722 | A | | 5/1976 | Bard | |
| 3,971,109 | A | | 7/1976 | Garza | |
| 4,003,592 | A | * | 1/1977 | Schreves | 289/16.5 |
| 4,111,471 | A | * | 9/1978 | Hanley | 289/16.5 |
| 4,131,138 | A | | 12/1978 | Boisvert | |
| RE30,656 | E | | 6/1981 | Davitian | |
| 4,332,405 | A | * | 6/1982 | Lawrason, Sr. | 289/16.5 |
| D266,799 | S | | 11/1982 | Mace | |
| 4,660,814 | A | | 4/1987 | Shader | |
| D321,277 | S | | 11/1991 | Tussing | |
| D330,982 | S | | 11/1992 | Braun | |
| 5,435,048 | A | | 7/1995 | Walker | |
| D434,299 | S | * | 11/2000 | McAtee | D8/71 |
| 6,672,577 | B2 | | 1/2004 | Murvine | |
| D486,604 | S | | 2/2004 | Glucksman | |
| 7,159,728 | B2 | | 1/2007 | Smith | |
| 2004/0035264 | A1 | * | 2/2004 | Kurtz | 81/488 |

OTHER PUBLICATIONS http://www.braidedrugshop.com/catalog.htm. Prior art braiding stand available online at least as early as Aug. 1, 2007.
www.mtnloom.com/kumi.htm. Another prior art braiding stand available online at least as early as Aug. 1, 2007.

* cited by examiner

*Primary Examiner*—Shaun R Hurley
(74) *Attorney, Agent, or Firm*—Leyendecker and Lemire, LLC; Kurt Leyendecker

(57) ABSTRACT

Embodiments of the present invention comprise a relatively lightweight collapsible and portable braiding stand to be used by braiding hobbyists to produce braided works including but not limited to rugs, wall hangings, chair pads, stair treads, bench cushions, bags and purses. Variations are comprised of a tubular plastic, such as PVC, and have the ability to be assembled in both chair and floor use configurations.

20 Claims, 3 Drawing Sheets

BRAIDING STAND

FIELD OF THE INVENTION

The present invention relates generally to products relating to the craft of fabric, textile and fiber braiding.

BACKGROUND

A braid typically refers to any object created by interweaving or intertwining three or more separate strands of one or more materials in a diagonally overlapping pattern. Braids are commonly involved in hairstyling and rope making; however, this document pertains to the craft or hobby of braiding typically used to produce flat works, such as but not limited to rugs, hanging art works and other articles for enhancing home decor produced from strips of textiles/fabrics or bundles of fibers.

To produce a braid a hobbyist interweaves three or more strands of fabric together. When a larger number of strands are used flat but relatively thick braids can be created. These braids may ultimately be sewn or stitched together to make larger pieces such as rugs. It is often desirable to affix a completed portion and/or a beginning distal end of the braid or collection of fabric strips such that the hobbyist can apply a measure of tautness to the fabric strips by pulling them as the strips are braided together. There are various means of accomplishing this known in the art. A hobbyist can place the completed portion of the braid on a table and weight down the completed portion by placing a book, stone or brick on it. Alternatively, the hobbyist can clamp the completed portion of the braid in place using, for instance using a vise mounted to a work bench. Perhaps most simply a hobbyist can place the completed portion between her/his legs or underneath her/his feet.

To facilitate the effective, quick and trouble free braiding several braiding stands have been developed. The first type of stand, such as the one described at www.mtnloom.com/kumi.htm and known in the art as a Kumihimo stand, comprises an elevated circular disk, typically made of wood, that includes a center aperture. A hobbyist places the beginning or completed portion of the braid through the opening and is weighs it down, such as with a sandbag. The portion of the fabric strands that have yet to be braided are distributed around the circumferential edge of the disk with their ends typically tied around weighted bobbins. To braid, the strands and their associated weighted bobbins are moved and shuffled around the outer edge of the disk in a desired sequence or pattern. As the strands are pulled over and under each other, a tight braid is formed. The process is repeated until the desired length of braid has been produced. While this type of braiding stand can very effective, in typically available configurations with center apertures of about 2" or less, they are not well suited to making wide and thick flat braids as are used in rugs for instance. Rather, this type of stand is most typically used to produce relatively thin ribbons and braided threads, such as might be used in fashion accessories. Further, the setup of this type of stand is relatively time consuming: a hobbyist has to weight the completed portion and tie the weight bobbins around each strand before beginning the braiding process. Finally, these stands are not particularly portable considering the disk itself is typically about 10" or more in diameter. Also, the weight of the bobbins and the center weight/sandbag make transporting the stand less desirable.

Stands typically comprised of wood are also known that comprise a base and an upwardly extending post about 30-36" or so in length. The top end of the post of these types of stands typically include one or both of a clamp and wire carding to hold a completed portion of a braid in place. The hobbyist sits or stands behind the stand and interweaves the various strands of fabric. As more of the braid is completed, the piece may be repositioned in the carding or clamp. The hobbyist may need to place her/his feet on the base of the stand to prevent it from tipping during use.

This type of stand suffers from several drawbacks. First, the post is typically too long to be conveniently transported around with the hobbyist. It is to be appreciated that a braider might desire to take her/his work piece with them as she/he goes about her/his regular daily activities such that she/he could braid during available breaks in the day. For example, a hobbyist might want to braid during her/his lunch break at lunch, during a car, bus or train ride to work or while flying in an airplane. The long post might prevent the hobbyist from conveniently packing the stand in a braiding bag or duffel bag, and as such she/he would be forced to forego braiding while away from the stand or resort to braiding without the stand, which may impact speed and/or quality.

A second drawback of the second type braiding stand is that the base is not particularly configured for comfortably receiving a person's feet thereon especially for extended periods of time. The crisscrossed legs of the prior art stand are raised above the ground about 1.5 inches or so and are relatively narrow in width (about 1.25" or so). Accordingly, the extra pressure applied to certain portions of the hobbyist's feet located on top of the stand's legs along with the angle the feet would have to be positioned in, could cause the hobbyist to have cramps or pain in her/his feet and/or lower legs.

Finally, the types of clamps used to hold the work piece on the second type of braiding stand often limit its usefulness. For instance, some types of clamps only permit braids comprising three strands to be made as opposed to braids having four or more strands. Advancing the braid in the clamp can be time consuming as it involves releasing the clamp and then pulling the work article through the clamp to a new position.

DETAILED DESCRIPTION

Figure 1:
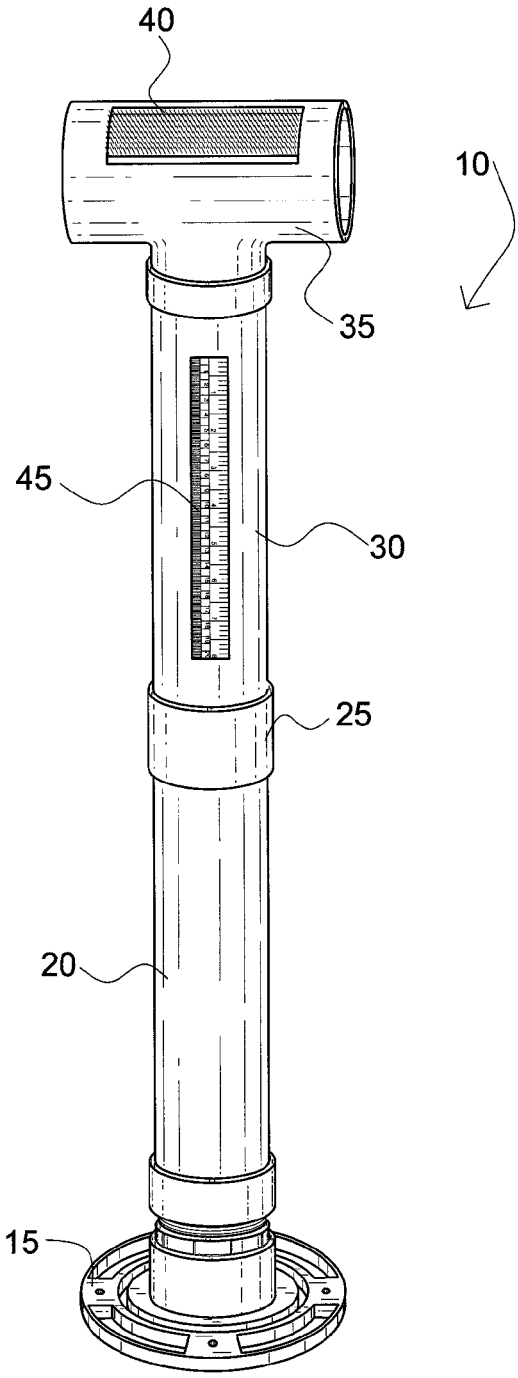
FIG. 1 is an isometric view of a floor configuration of a braiding stand according to an embodiment of the present invention.

Embodiments of the present invention comprise a relatively lightweight collapsible and portable braiding stand to be used by braiding hobbyists to produce braided works including but not limited to rugs, wall hanging and other decorative items.

One embodiment of the stand is comprised of plastic tubing such as PVC piping that easily couples to form either a full height floor version or a shortened chair version. The stand also includes a circular flanged base with a relatively thin flanged portion that can be positioned either underneath a hobbyist's feet when used in the floor configuration or underneath the hobbyist's legs when used in the chair configuration without causing the hobbyist significant discomfort.

Because the stand can be configured into at least two different configurations, a hobbyist can easily adapt the stand for use in her/his particular surroundings. For example, in an automobile, on a commuter train or on a commercial airplane were floor space is scarce, the hobbyist may use a chair configuration that fits between her/his legs while when in a airline terminal, the hobbyist may use the floor configuration because floor space is more plentiful. Furthermore the chair configuration is more easily transported thus making it suitable for taking it to braiding classes or braiding camp.

The chair configuration can also be used at home in place of the floor stand. The chair configuration causes a braider to work her/his shoulder and back muscles differently than the floor configuration. Some braiders may find one configuration desirable over the other. Further, some braiders may switch between the two configurations to minimize the strain and fatigue on the relevant muscles.

When embodiments of the stand are fully disassembled the maximum length of any one piece is about 15" or less and the flanged base has a diameter of less than about 10". Accordingly, the whole stand can be placed in a duffel bag that also includes one or more braided pieces and various braiding materials.

Additionally, embodiments of the braiding stand can be very inexpensively produced. In one embodiment, the base and all the necessary piping is readily available through plumbing suppliers at very low cost. Minimal manufacturing is required to produce the stand save for a few cuts of the tubing and a few solvent bonds. Accordingly, the entire unit can be produced for less than less versatile prior art wood braiding stands.

Terminology

The term "or" as used in this specification and the appended claims is not meant to be exclusive rather the term is inclusive meaning "either or both".

References in the specification to "one embodiment", "an embodiment", "a preferred embodiment", "an alternative embodiment", "one variation", "a variations" and similar phrases mean that a particular feature, structure, or characteristic described in connection with the embodiment is included in at least an embodiment of the invention. The appearance of the phrase "in one embodiment" or "in an embodiment" in various places in the specification are all not necessarily meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

As applicable, the terms "about" or "generally" as used herein unless otherwise indicated means a margin of +−20%. Also, as applicable, the term "substantially" as used herein unless otherwise indicated means a margin of +−10%. It is to be appreciated that not all uses of the above terms are quantifiable such that the referenced ranges can be applied.

An Embodiment of a Braiding Stand

Figure 2:
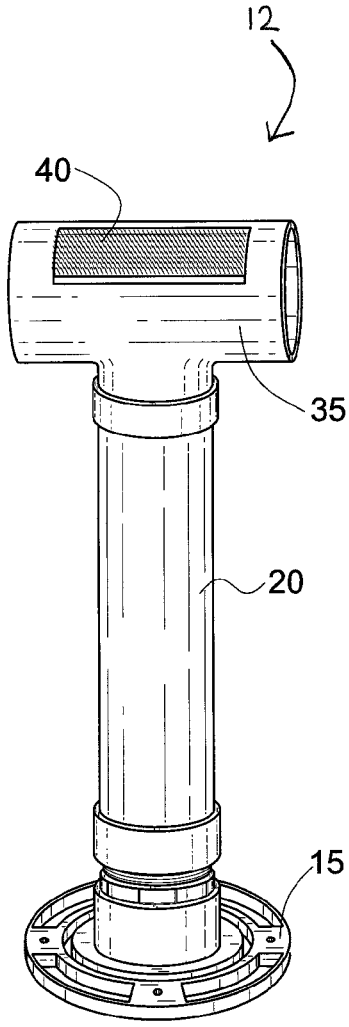
FIG. 2 is an isometric view of a chair configuration of a braiding stand according to an embodiment of the present invention.
Figure 3:
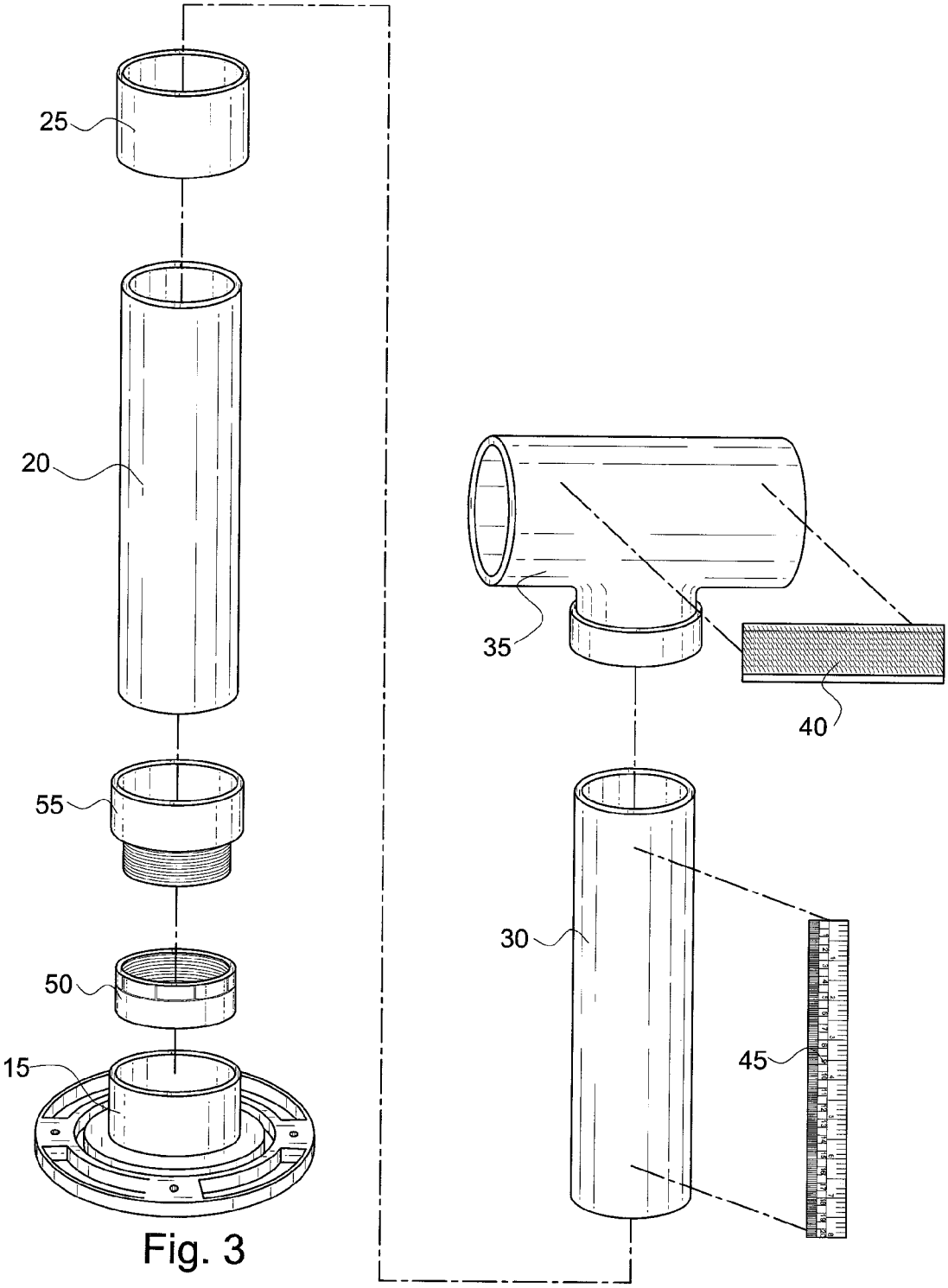
FIG. 3 is an exploded isometric view of the floor configuration of a braiding stand according to an embodiment of the present invention.
Figure 4:
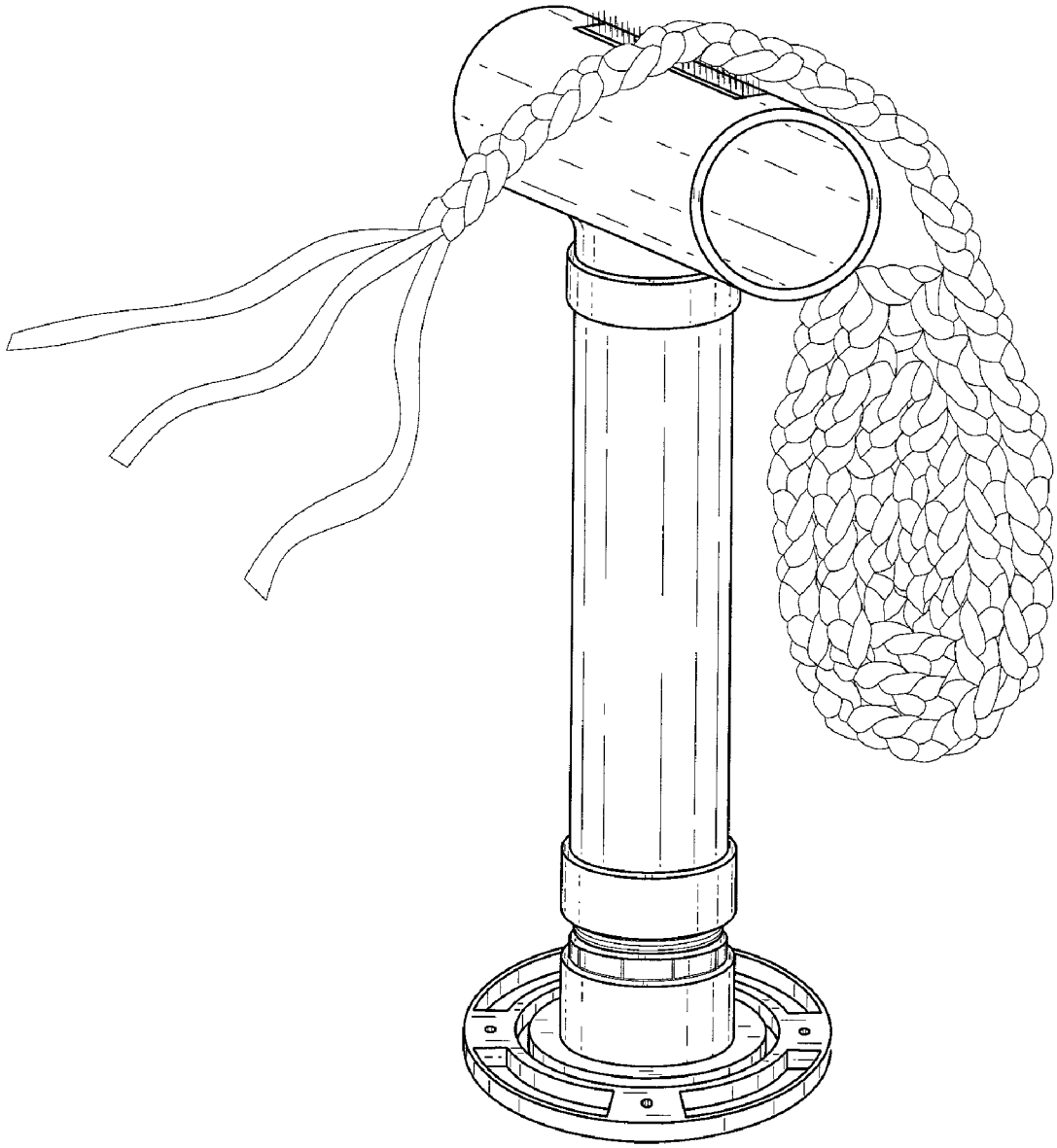
FIG. 4 is an isometric view of a floor configuration of a braiding stand with a braided piece attached thereto according to an embodiment of the present invention.

Referring to FIGS. 1-3 an embodiment of a braiding stand is illustrated in various configurations. FIG. 1 shows the stand in an assembled floor configuration. FIG. 2 shows the stand in a chair configuration, and FIG. 3 shows an exploded view of the floor configuration of the stand.

With reference to FIGS. 1 & 3, the floor configuration of the stand stands about 28-30" tall although variations that are taller or shorter are contemplated. It is appreciated that variations in height are easily provided based on the length to which one of the primary tube sections 20 & 30 are cut. All the components of the stand save for the wire carding 40 and an optional scale 45 provided on the surface of one of the tube sections are comprised of 2" ABS or PVC pipe and associated fittings. In some variations, the piping and fittings are identical to commonly used plumbing tubing and fittings that can be readily purchased from a plumbing supply store or directly from the manufacturer. Accordingly, special production runs or specialized tooling are not required to produce the various components.

In yet other variations, the tubing and the various fixtures can be specially and specifically configured for use in a braiding stand. For instance, thinner lighter tubing and fittings may be utilized in place of heavier off-the-self items that are stouter for use in high pressure plumbing applications. Further, a number of fittings may be eliminated or integrated with other pieces. For instance, the two base threaded adapters 50 & 55 can be eliminated with the bottom of the lower tube section being externally or internally threaded to mate with a correspondingly configured receiving portion of the flanged base member 15. Likewise, the tubular coupler 25 can be eliminated and integrally molded into the upper tubular section. However, the specific embodiment illustrated and specifically described herein pertains to an embodiment of a stand constructed of readily available off-the-shelf plastic products.

The embodiment of the stand illustrated in FIGS. 1 & 3 comprises: (i) a flanged base assembly that includes a flanged base member 15 and a female threaded adapter 50; (ii) a lower tube assembly that includes a plastic first tube section 20 and a male threaded adapter 55; (iii) an upper tube assembly that includes a tubular coupler 25, a plastic second tube section 30 and an optional scale 45; and (iv) a braid catch assembly including a tubular T-fitting 35 and a rectangular section of wire carding 40.

The flanged base member comprises an ABS or PVC closet flange that is more typically utilized to mount a toilet to a toilet drainpipe and the floor. The flanged base member includes a circular flanged portion that is about 7" in diameter and a bit shy of 0.5" thick at its edge. The center of the flanged base member comprises a tubular receiver portion that is adapted to receive a coupling adapter sized to join 2" PVC or ABS pipe relatively tightly therein. There are a plurality of holes and arcuate slots provided around and through the flanged portion that are typically utilized to secure the closet flange to a floor and secure a toilet to it. These particular features are not utilized in the present application and alternative flanged bases with flanged portions that do not have these features are contemplated. Further, in variations, the flanged portion may be larger or smaller in diameter than that of the closet flange. Additionally instead of a square edge, the edge of the flanged portion in variations can be outwardly tapered to make the flange more comfortable under leg or foot.

To create the flange base assembly as shown in the illustrated embodiment, a threaded female adapter 50 is received into the receiver portion of the flanged base member. The adapter is commonly available through plumbing supply stores in ABS or PVC. It comprises a lower unthreaded portion with an outside diameter similar to or slightly smaller than the inside diameter of the receiver portion, and an upper portion with a threaded female interior circumferential wall. The lower portion is typically adhesive or solvent bonded into the flanged base member 15 to for the flange base assembly.

In variations of the flange base assembly, a coupling adapter 25 may be bonded to the receiver portion of the flanged base member to create flanged base assembly that can receive a 2" PVC or ABS pipe directly therein through an interference fit similar to the interference fit provided between the illustrated coupling adapter 25 on the upper tube assembly and the second tube section of the lower tube assembly as is described in greater detail below. However, in the illustrated embodiments of FIGS. 1-3, the threaded connection provided by using the female threaded coupler is generally preferred over an interference fit for the greater rigidity and stability it offers.

Concerning other embodiments using custom configured flange bases as used in other embodiments, a threaded or interference fit portion may be integrated with a receiver portion of a flanged base member, or some other connection means may be provided, such as but not limited to a twist lock connector.

The flange base assembly is threadably and removably coupled to the lower tube assembly by way of the threaded male coupler 55 that includes a lower portion comprising a threaded exterior circumferential wall that is adapted to be received in the female threads of the flange base assembly. The coupler also includes an upper portion having an interior with a diameter similar or slightly larger than a 2" PVC or ABS pipe to receive the pipe therein. As with most of the components of the braiding stand, the threaded male coupler 55 is commonly available through plumbing supply distributors.

The threaded male coupler of the lower tube assembly is adhesive or solvent bonded to a first tube section 20. The first tube section, and incidentally the second tube section 30, comprise commonly available plumbing grade 2" PVC or ABS pipe. In one variation, the length of first section is about 12" with the entire length of the lower tube assembly being about 13", although other sizes maybe utilized.

The upper tube assembly comprises a coupler 25 that is adhesively or solvent bonded to the exterior of the second tube section 20 on a bottom end thereof. As with other components, the coupler is commonly available through plumbing supply distributors. The coupler is slid over the upper end of the lower tube assembly and the two tube assemblies are removably attached through an interference fit. While joining the upper and lower tube assemblies by way of an interference fit has proven to be suitably secure given the lower moment loading compared with the flange base assembly and lower tube assembly connection, it is to be appreciated that the respective tube assemblies could be modified to utilize threaded couplers to joined them much in the same fashion as the lower tube assembly is joined to the flange base assembly. In fact the same threaded couplers 50 & 55 can be utilized as the lower portion of the threaded female coupler includes an interior bore adapted to receive a 2" ABS or PVC tube therein.

Optionally, on the upper tube assembly (or lower tube assembly) an adhesive backed scale 45 can be affixed to the outside surface of the second tube section giving the hobbyist a convenient means of measuring and thereby obviating the need to utilize or carry a separate scale in conjunction with the stand. The scale can be demarked in any suitable units such as English and/or Metric units.

It is appreciated that in other embodiments the diameter, thickness and material comprising the first and second tubes 20 can be varied, and as mentioned above, the various threaded and interference fit coupling fittings can be integrally molded or fabricated into the tube sections. For instance, lighter and thinner tube sections could be utilized that cut the total effective weight of the stand as the strength and stoutness of the pressure certified ABS and/or PVC tubing is not required for the braiding stand. It is further understood that more than two tubular sections or a single tubular section can be utilized in place of the three illustrated. Although the illustrated tubes are circular in cross section, tubes that comprise oval, rectangular or polygonal cross sections can also be used. In yet other embodiments, the various extension sections need not comprise tubes but can comprise C-channels or L-sections or even I-beam sections.

The braid catch assembly comprises a commonly available plumbing PVC or ABS T-fitting 35 that can be removably received over the top end of the upper tube assembly. Adhesively or mechanically affixed to the surface of the generally horizontally extending arms of the T-fitting is a generally horizontally-extending piece of wire carding 40. Typically, the wire carding is about 2-5 inches in length and about ¾-1½ inches wide. The carding is fixedly attached to the T-fitting such that a longitudinal center lengthwise axis of the piece of carding is preferably located between 10-80 degrees off of vertical along the exterior surface of the tubular arms. The various wires comprising the carding are generally slightly curved or hooked with the curve or the hook extending partially downwardly.

As with the other coupling connections between the various subassemblies, the connection between the braid catch assembly and the upper tube assembly can also vary in other embodiments. For instance threaded couplings can be utilized to create a threaded attachment between the two assemblies in place of the interference fit. It is further appreciated that the configuration of the braid attachment assembly can vary substantially and significantly as long as it serves its intended purpose of effectively holding a braided piece in place when subjected to typically pulling forces as applied by a braider during use. Further, variations of the illustrated embodiment and other embodiments are contemplated wherein the carding is replaced with another holding devices, such as but not limited to spring biasing clamps, screw clamps, magnetic clamps, and securing straps.

The braiding stand embodiment has been described primarily in relation to FIGS. 1 & 3, which illustrate a floor version or configuration 10. A chair or even table top version is also contemplated with a chair configuration 12 being illustrated in FIG. 2. The chair configuration utilizes the flange base assembly, the lower tub assembly and the braid catch assembly wherein the braid catch assembly is received over the top of the first tube section of the first tube section in place of the top of the second tube section. In all other respects, the chair configuration is substantially similar in components as the floor configuration. It is further appreciated that the plurality of openings in the flanged base member 15 can be utilized to bolt or otherwise fasten the stand to a work bench or table.

Method of Utilizing Braiding Stand According to an Embodiment

The braiding stand embodiments described herein permit a braiding hobbyist to easily transport her/his braiding stand and quickly reassembly it in one of two or more configurations for use in most environments. The stand when not in use and stored or when being carried or transported is small enough to be carried in a relatively small duffle bag, back pack or even a paper or plastic shopping bag in conjunction with strips of fabric and, as applicable a current work piece.

When the hobbyist decides to braid using the stand, she/he will typically survey the surroundings and decide whether there is sufficient floor space available to use the floor configuration. If there isn't sufficient floor space or by using the available floor space she/he will possibly inconvenience others, than she/he will remove the necessary components to assemble the chair configuration of the stand. Using the illustrated embodiment as an example, the hobbyist would attach the flange base assembly to the lower tube assembly and slide the braid catch assembly over the top of the lower tube assembly.

If there is sufficient floor space available the hobbyist may elect to assemble a floor configuration of the stand. The hobbyist would: attach the flange base assembly to the lower tube assembly; slide the upper tube assembly over the lower tube assembly; and slide the braid catch assembly over the top of the lower tube assembly.

Once the stand is configured and assembled the hobbyist either places the stand between her/his upper legs with the bottom resting on the chair the hobbyist is sitting in for the chair configuration, or she/he places the floor configuration stand on the floor and places her/his feet over the flange portion of the flanged base member 15.

A completed section of the work piece that is being braided or a beginning end of a plurality of strands of fabric are placed against the carding such that the portion to be braided extends of the top of the T-fitting and towards the hobbyist. In other words, the carding generally faces away from the hobbyist, such that pulling on the work piece pulls the portion of the piece in contact with the carding slightly upwardly and also into the carding. The individual wires of the carding dig into the piece and prevent it from sliding towards the hobbyist as she/he braids the piece.

When the hobbyist has finished a braiding session, she/he can disassemble the stand and store it in its associated bag, backpack or other container optionally along with the work piece and other strips of fabric.

Other Embodiment and Other Variations

The various preferred embodiments and variations thereof illustrated in the accompanying figures and/or described above are merely exemplary and are not intended to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

I claim:

1. A portable braiding stand comprising:

a base including a generally planar portion extending outwardly from a center portion, the planar portion being less than 1" thick;

two or more extension sections, each extension section being no more than 18" in length, a first extension section of the two or more extension sections being adapted to removably couple with the base section, the two or more extension sections being adapted to linearly and removably couple with each other;

a braid holder, the braid holder being adapted to couple with at least one of the first and second extension sections, and including at least one piece of carding secured thereto, the cardings being adapted to removably secure a braiding piece thereto.

2. The braiding stand of claim 1, wherein the base comprises a closet flange.

3. The braiding stand of claim 1 wherein the planar portion has a diameter of about 7".

4. The braiding stand of claim 1 wherein the two or more extensions sections substantially comprise tubes.

5. The braiding stand of claim 4, when the base and the first extension section are adapted to threadably couple.

6. The braiding stand of claim 4, wherein the first extension section and a second extension section are interference fit using a tubular coupling adapter having an inside diameter similar to an outside diameter of an end of each of the first and second extension sections.

7. The braiding stand of claim 4, wherein the two or more extension sections comprise 2" ABS or PVC plumbing pipe.

8. The braiding stand of claim 4, wherein the braid holder comprises a tubular T-fitting having a single tubular leg portion integrally formed with and extending from an approximate lengthwise center of a tubular arm portion.

9. The braiding stand of claim 8, wherein the braid holder further comprises carding fixedly secured to the tubular arm portion.

10. The braiding stand of claim 8, wherein a longitudinal axis of the carding extends along a direction generally perpendicular to the first extension section at when the stand is assembled, the longitudinal axis being located 10-80 degrees off of vertical along the exterior surface of the tubular arm portion.

11. The braiding stand of claim 8, wherein the tubular leg portion is adapted to frictionally receive an end of an extension section of the two or more extension sections therein.

12. A method pertaining to the braiding stand of claim 1 comprising:

coupling the base to the first extension section wherein the planar portion of the base is substantially perpendicular to a longitudinal axis of the first extension section;

coupling a second extension section of the two or more extension sections to the first extension section to form an extended extension section; and coupling the braid holder to an end of the extended extension section;

whereby a braiding stand suitable for being positioned on a ground surface and held under a braider's feet is created.

13. A method of assembling the braiding stand of claim 1 comprising:

coupling the base to a first end of the first extension section wherein the planar portion of the base is substantially perpendicular to a longitudinal axis of the first extension section; and coupling the braid holder to a second end of the first extension section, the second end being opposite the first end;

whereby a braiding stand suitable for being positioned on a chair between a braider's legs is created.

14. The method of claim 12, further comprising:

storing the base, two or more extension sections and the braid holder in a carrying bag wherein the longest dimension of an interior space of the carrying bag is not to exceed about 24 inches; and removing the base, at least two of the two or more extensions, and the braid holder from the bag.

15. The braiding stand of claim 1 wherein the braiding stand is capable of being assembled into at least two configurations: a first configuration adapted for resting the base on a chair between a braider's legs with the first configuration having a total height of less than about 18 inches; and a second configuration having a total height of more than about 28 inches adapted for resting the base on a floor with the braider's feet being placed over the generally planar portion.

16. A braiding stand comprising: (i) a base assembly including a flange extending outwardly from a centrally located first threaded adaptor; (ii) a first extension assembly comprising a first polymeric tube having first and second ends, the first end having a second threaded adapter fixedly secured thereto, the second threaded adapter adapted for being threadably engaged with the first threaded adapter; (iii) a second extension assembly comprising a second polymeric tube having third and fourth ends and a frictional coupling adapter fixedly secured to the third end, the frictional coupling adapter adapted to receive the second end of the first polymeric tube tightly therein; (iv) a tubular T-fitting having a single tubular leg extending orthogonally outwardly of a midpoint location of a tubular arm portion, the leg portion being adapted to receive the fourth end of the second polymeric tube tightly therein; and a piece of carding fixedly secured to the arm portion of the tubular T-fitting.

17. The braiding stand of claim 16 wherein the first and second polymeric tubes comprise one or both of ABS or PVC plastic 2" gauge plumbing pipes.

18. A method of braiding comprising:

assembling a braiding stand into one of at least a first or a second configuration, the braiding stand comprising, (i) a base section including a generally planar portion extending outwardly from a center portion, the planar portion being less than 1" thick, (ii) one or more extension sections, a first extension section of the one or more extension sections being adapted to removably couple with the base section, (iii) a braid holder, the braid holder being adapted to (i) couple with the one or more extension sections, and (ii) removably secure a braiding piece thereto, wherein the first configuration comprises an assembled braiding stand having an overall height of less than about 18" and the second configuration comprises an assembled braiding stand having a height of at least about 28";

one of (a) resting the braiding stand assembled into a first configuration on a ground surface and placing a braider's feet over the planar portion, and (b) resting the braiding stand assembled into a second configuration on a seating surface of a chair with the first extension section rising upwardly between the braider's legs;

securing a portion of a work piece to be braided to the braid holder;

braiding strands of fabric that comprise the work piece.

19. The method of claim 18, further comprising: removing the base section, one or more extension sections and the braid holder from a storage bag prior to or concurrently with said assembling the braiding stand.

20. The method of claim 18, wherein: the base section comprises a closet flange; the one or more extensions comprise plastic plumbing pipe; and the braid holder comprises a tubular T-Fitting with a piece of carding affixed thereto.

* * * * *